United States Patent [19]

Kinder

[11] Patent Number: 4,767,292

[45] Date of Patent: Aug. 30, 1988

[54] ELECTRICAL COMMUTATION APPARATUS

[75] Inventor: Mark R. Kinder, Lafayette, Ind.

[73] Assignee: TRW Inc., Lyndhurst, Ohio

[21] Appl. No.: 75,445

[22] Filed: Jul. 20, 1987

[51] Int. Cl.[4] ..... F01C 1/10; F01C 21/12; F03C 2/08; F15B 13/16

[52] U.S. Cl. ..... 418/2; 418/270; 418/61.3; 91/53; 91/362

[58] Field of Search ..... 418/2, 61 B, 270; 91/53, 362

[56] References Cited

U.S. PATENT DOCUMENTS

| | | | |
|---|---|---|---|
| Re. 25,257 | 10/1962 | Ellis, Jr. | 91/362 |
| 2,976,843 | 3/1961 | Weibel | 91/362 |
| 2,999,482 | 9/1961 | Bower . | |
| 3,156,157 | 11/1964 | Smith et al. . | |
| 3,289,602 | 12/1966 | Hudgens . | |
| 3,778,198 | 12/1973 | Giversen | 418/61 B |
| 3,799,201 | 3/1974 | Hansen et al. . | |
| 3,917,437 | 11/1975 | Link . | |
| 3,922,120 | 11/1975 | McCullough et al. . | |
| 3,996,901 | 12/1976 | Gale et al. . | |
| 4,087,215 | 5/1978 | Miller . | |
| 4,219,313 | 8/1980 | Miller et al. . | |
| 4,380,420 | 4/1983 | Wusthof et al. . | |
| 4,411,606 | 10/1983 | Miller . | |

FOREIGN PATENT DOCUMENTS

| | | | |
|---|---|---|---|
| 57-102576 | 6/1982 | Japan | 418/61 B |
| 57-108472 | 7/1982 | Japan | 418/61 B |
| 59-70888 | 4/1984 | Japan | 418/61 B |

*Primary Examiner*—John J. Vrablik

*Attorney, Agent, or Firm*—Tarolli, Sundheim & Covell

[57] ABSTRACT

A fluid motor having a gerotor gear set includes a first member having internal teeth and a second member having external teeth. The second member is rotatably and orbitally mounted within the first member. The teeth of the first and second members cooperate to define a plurality of variable volume working chambers. Some of said working chambers expand and other of said working chambers contract upon relative rotatable and orbital movement between said first and second members. A plurality of electrically controlled valves are provided, each working chamber having an associated valve. Each valve selectively communicates, in one condition, its associated working chamber with an inlet passage, which is, in turn, connected to a source or pressurized fluid, or, in a second condition, its associated working chamber to an outlet passage, which is, in turn, connected to a reservoir. Each of the valves is responsive to a respective electrical control signal for placing the valve in the first or second condition.

17 Claims, 6 Drawing Sheets

ELECTRICAL COMMUTATION APPARATUS

BACKGROUND OF THE INVENTION

1. Field of the Invention

The present invention relates to a fluid device, such as a fluid pump or a hydraulic motor, having a plurality of expanding and contracting working chambers defined by interacting teeth of a gerotor gear set. Specifically, the present invention relates to a commutation apparatus for directing fluid flow to and from such working chambers.

2. BACKGROUND ART

Hydraulic devices, such as pumps or motors, which have a plurality of expandable and contractable working chambers formed by interacting teeth of a gerotor gear set are known. Typically, the gerotor gear set includes a stator having internal teeth and a rotor having external teeth. The rotor, which has one less tooth than the stator, is eccentrically disposed within the stator. The rotor is mounted for rotational and orbital movement relative to the stator and is supported by and guided in such movement by the teeth of the stator. The interacting teeth of the rotor and stator define the plurality of working chambers which expand and contract during the rotor's movement.

Various valve constructions have been developed for directing fluid into and out of the expanding and contracting working chambers. Such valve constructions are known in the art as commutator valves. Examples of such commutator valves are disclosed in U.S. Pat. Nos. 4,087,215, 4,219,313, and 4,411,606. The commutator valves disclosed in these patents include mechanically rotatable valve members. The valve members have precisely located openings and lands which, during rotation of the valve members, are timed (i) to selectively block fluid flow to or from working chambers, (ii) permit fluid flow to expanding working chambers, and (iii) permit fluid flow from the contracting working chambers.

The commutator valve arrangements of known hydraulic devices often require precise machining and/or assembly. In a hydraulic motor, such commutator valves do not permit precise control of the speed of an output shaft of the hydraulic motor nor precise control of the final rotational position of the output shaft when the motor is stopped. Such precise control is necessary for the application of a gerotor type hydraulic motor in robotics and automated manufacturing. Such an application would require a motor to have a high load carrying capacity, a relatively high operating speed, precise position control of the output shaft when the motor is stopped, an ability to provide incremental movement of the output shaft, and reversible operation.

SUMMARY OF THE INVENTION

The present invention provides an apparatus for controlling fluid flow to and from a gerotor type fluid device, such as a hydraulic motor or pump. A hydraulic motor using a commutation apparatus in accordance with the present invention permits precise control of the motor speed, direction, displacement, stopping and starting characteristics, position of the motor output shaft, incremental movement of the motor output shaft, and reversible operation.

The apparatus, in accordance with the present invention, can be used with a fluid motor having a gerotor gear set including a stator having a plurality of internal teeth and a rotor having a plurality of external teeth. An output shaft is drivably connected to the rotor. The stator has one more tooth than the rotor. The teeth of the stator and rotor cooperate to define a plurality of variable volume working chambers. The stator and rotor are relatively rotatable and the rotor moves in an orbital path relative to the central axis of the stator. In a hydraulic motor, the relative rotational and orbital motion result from the expansion and contraction of the working chambers. The rotational and orbital motion of the rotor drives the output shaft in rotation. An inlet passage is connected to a source of pressurized fluid and is connectable to selected working chambers to effect expansion of those selected working chambers. An outlet passage is connected to a reservoir and is connectable to other of the working chambers to conduct fluid from the other of the working chambers upon their contraction.

A preferred embodiment of an apparatus, in accordance with the present invention, includes a plurality of electrically actuatable valve means. Each of the valve means is in fluid communication with the inlet and outlet passages and with just one associated working chamber. Each valve means controls fluid flow to and from its associated working chamber. Each of the valve means has a movable valve member that can be controllably moved to a first position and a second position. The valve member, when in the first position, permits fluid communication between its associated working chamber and the outlet passage. The valve member, when in the second position, permits fluid communication between the inlet passage and its associated working chamber. Movement of a valve member is controlled by an associated solenoid. The valve member is spring biased to one of the two positions and is actuatable, in response to an electrical control signal from a controller, to the other position.

The controller is preferably a microprocessor based control system which receives an input signal from an appropriate input source indicative of a desired motor output shaft speed, direction of output shaft rotation, and/or position of the output shaft when the motor is stopped. The controller also receives an electrical signal from a position sensor indicative of the relative position of the rotor and the stator which is, in turn, indicative of the position of the output shaft. Based upon the position sensor signals, the controller determines the speed and direction of the output shaft. The controller outputs appropriate electrical control signals to the solenoids of the valve means responsive to the input signal from the input source. The controller continuously monitors current motor conditions based upon the output signals from the position sensor. The controller actuates a particular one of, or a plurality of, the solenoids of the valve means so as to provide the desired motor speed, direction of movement and/or final stop position of the output shaft.

BRIEF DESCRIPTION OF THE DRAWINGS

Other features and advantages of the present invention will become apparent to those skilled in the art to which the present invention relates from a reading of the following description of a preferred embodiment with reference to the accompanying drawings, in which.

DESCRIPTION OF A PREFERRED EMBODIMENT

The present invention relates to an improved commutator apparatus for controlling fluid flow to and from working chambers of a fluid device having a plurality of expandable and contractible working chambers. The invention is described herein as embodied in a hydraulic motor. However, from the description, it will be apparent to those skilled in the art that the invention can be used in other fluid devices having a plurality of expandable and contractible working chambers, such as a fluid pump.

Figure 1:
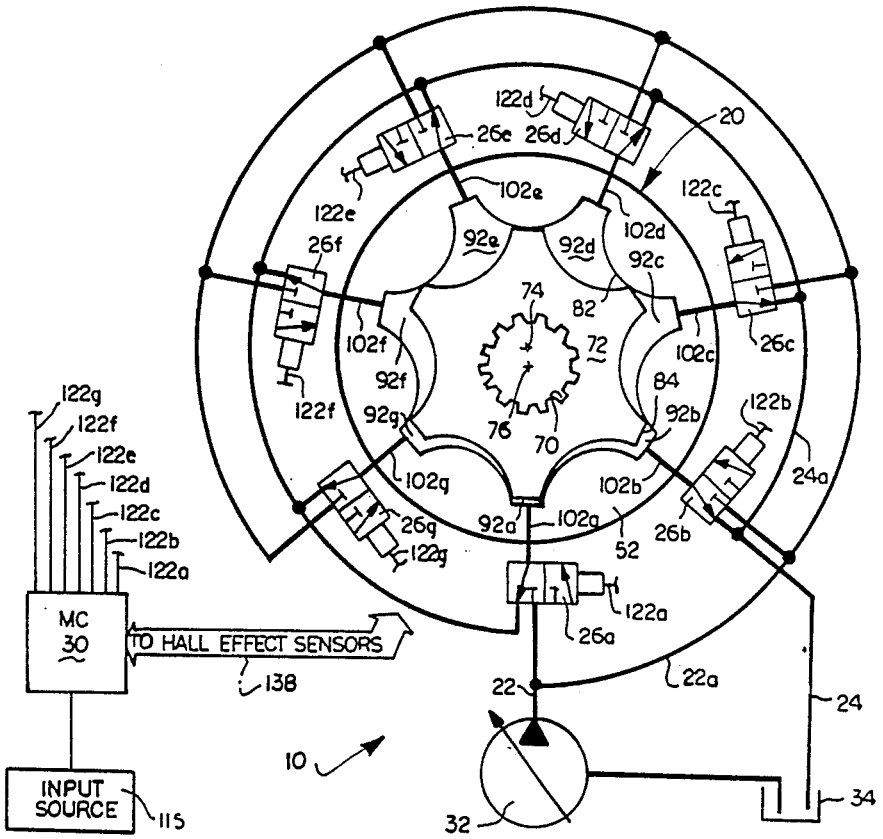
FIG. 1 is a schematic illustration of the present invention as embodied in a fluid motor.
Figure 2:
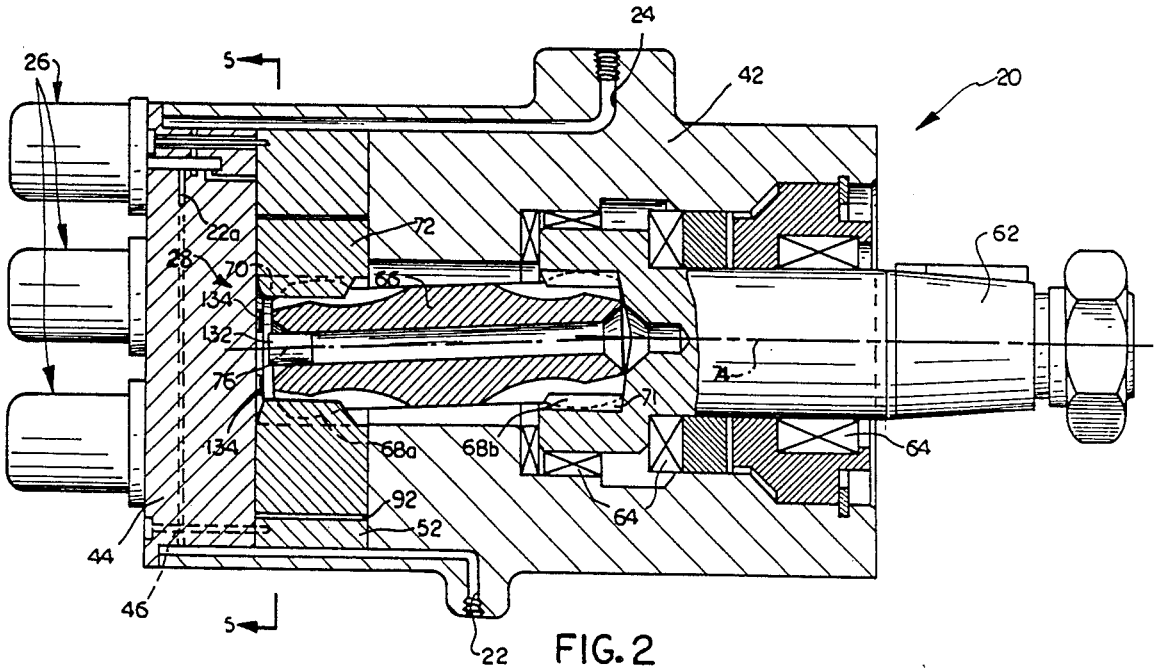
FIG. 2 is a cross-sectional side view of the fluid motor of FIG. 1.
Figure 1A:
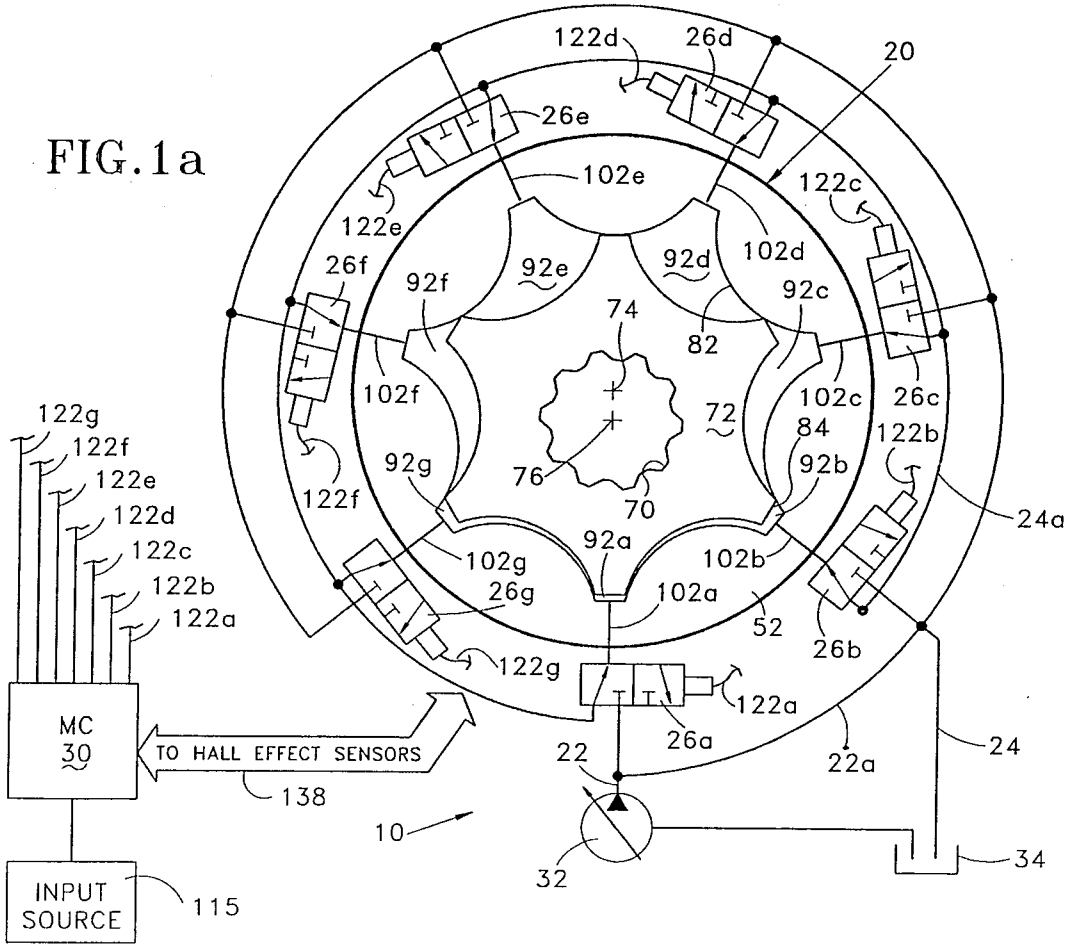
FIG. 1*a* is a schematic illustration of another embodiment of the present invention in a fluid motor.

Referring to FIGS. 1 and 2, the hydraulic system 10 includes a hydraulic motor 20, an inlet passage 22, an outlet passage 24, a plurality of control valve assemblies 26, a position sensor 28 (FIG. 2) and a controller 30 (FIG. 1). The hydraulic system 10 also includes a pump 32 in fluid communication with the inlet passage 22 and with a reservoir 34. The outlet passage 24 is in fluid communication with the reservoir. The pump 32 is preferably a variable displacement, constant pressure pump which is well known in the art.

The hydraulic motor 20 includes a housing 42 (FIG. 2) and an end cap 44. A stator 52 is received in a recess in the housing 42. The stator 52 is preferably made of a one-piece homogeneous casting or powdered metal member. The end cap 44 is secured to the housing 42 by conventional means, such as by a plurality of bolts 46, with the stator 52 held in a fixed position by friction between the end cap 44 and the housing 42.

Seals 54 (FIG. 3) are received in grooves 56 in the stator 52 and are compressed upon assembly to prevent fluid loss from between mating surfaces of the end cap 44, stator 52 and housing 42. A seal 58 is disposed in a radially recessed portion 60 of the end cap 44 to prevent fluid loss from between the housing 42 and the end cap.

An output shaft 62 (FIG. 2) is supported for rotation about an axis 74 in the housing 42 by bearings 64. A wobble shaft 66 is provided having outwardly projecting splines 68*a*, 68*b* at its axially opposite ends. The wobble shaft 66 has a longitudinal axis 76 which is angularly offset relative to the longitudinal axis 74 of the output shaft 62.

A rotor 72 is disposed within the stator 52. The stator 52 and rotor 72 form a gerotor gear set of the hydraulic motor 20. The rotor 72 has internal directed splines 70 formed therein. The splines 68*a* of the wobble shaft 66 interengage splines 70 in the rotor 72. The output shaft 62 has inward directed splines 71 formed in an internal end portion. The splines 68*b* of the wobble shaft 66 interengage splines 71 in the output shaft 62 for a driving connection between the rotor 72 and the output shaft 62.

The output shaft 62 is driven in rotation by orbital and rotational movement of the rotor 72 relative to the stator 52. In the illustrated embodiment, the stator 52 has seven circumferentially spaced internal teeth 82. The rotor 72 has six circumferentially spaced external teeth 84. During operation, the teeth 82, 84 interact such that when the rotor 72 rotates about its axis 76, it also orbits about the central axis 74 of the stator 52.

The gear teeth of the rotor 72 and stator 52 interact to define a plurality of variable volume working chambers 92. The rotor 72 is driven in its orbital and rotational movement relative to the stator 52 by controlling fluid pressure in working chambers 92 formed by the interacting teeth 82, 84. For example, if pressurized fluid is conducted through the inlet passage 22 from the pump 32 and communicated with a working chamber 92*c*, the fluid pressure acts on the gear teeth surface which causes the working chamber 92*c* to expand and the rotor 72 to rotate about its axis 76. As the working chamber 92*c* is expanding, chamber 92*f* is contracting in volume, fluid is forced out of the working chamber 92*f* into the return passage 24.

The axis 76 of the rotor 72 orbits about the stator axis 74 six times for each complete revolution of the output shaft 62. There are 42 combinations of any single tooth 84 of the rotor 72 engaging a tooth 82 of the stator 52 for each revolution of the output shaft 62. One revolution of the output shaft 62 requires 42 successive compressions and expansions of the working chambers 92. Thus, each revolution of the output shaft 62 can be divided into 42 steps. It will be apparent that the gerotor gear set of the motor 20 may have more teeth than those illustrated in the preferred embodiment to provide better resolution of the movement of the output shaft 62.

Figure 3:
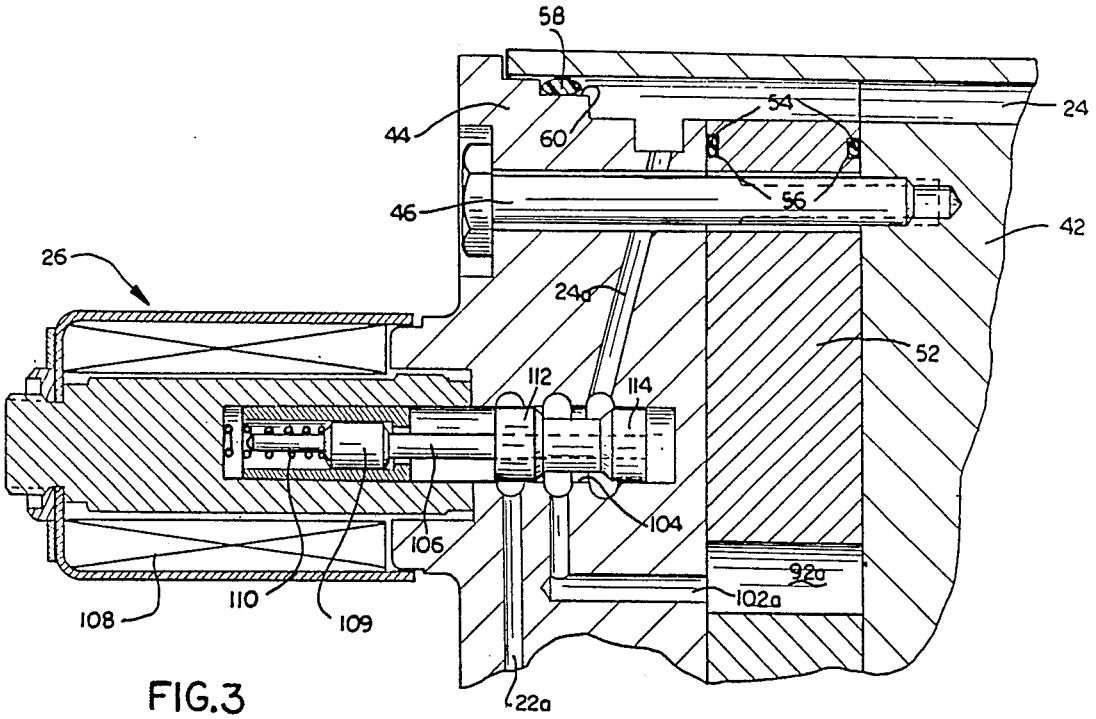
FIG. 3 is an enlarged cross-sectional view of a portion of the fluid motor of FIG. 2.

Referring to FIG. 3, the housing 42 and end cap 44 define a plurality of passages through which fluid is conducted to and from the working chambers 92. The housing 42 has passages 22, 24 located therein. The end cap 44 includes passage portions 22*a*, 24*a* respectively in fluid communication with the inlet passage 22 and outlet passage 24. The end cap 44 also includes a plurality of working chamber passages 102, each working chamber passage being in communication with an associated working chamber 92. Each the of working chambers 92 has an associated control valve assembly 26. Each of the control valve assemblies 26 is fixed to the end cap 44.

Each of the control valve assemblies 26 is similarly constructed. For the purposes of clarity in discussion, only one control valve assembly is described in detail, it being understood that each of the other control valve assemblies is similarly constructed. A control valve assembly 26 includes a valve member 106 which is slidably received in a fluid chamber 104. Fluid chamber 104 is a common junction for the inlet passage 22*a*, outlet passage 24*a*, and working chamber passage 102*a*. Each of the passages 22*a*, 24*a* and 102*a* communicate with a respective annulus formed radially outward from the wall surface defining the fluid chamber 104. The valve member 106 has two land portions 112, 114 which cooperate with the wall surface of the chamber 104 to permit fluid communication between the working chamber passage 102*a* and a selected one of the inlet passage 22*a* or the outlet passage 24*a*.

The control valve assembly 26 further includes a coil 108 that is electrically energizable. The valve member 106 includes a body portion 109 upon which a magnetic field produced by energization of coil 108 acts. A spring 110 biases the valve member 106 to a first position when the coil 108 is not energized. When the coil 108 is electrically energized, a magnetic field is produced which acts on the body portion 109. The magnetic field moves the body portion 109 toward the longitudinal center of the coil 108. When the body portion 109 is moved toward the coil center, the valve member 106 is in a second position.

FIG. 3 illustrates the valve member 106 in the first position, which is also referred to as an unactuated condition. When the valve member 106 is in the first position, its associated working chamber 92*a* is vented to the reservoir 34 by providing a fluid communication path between the working chamber 92*a*, the working chamber passage 102*a*, the fluid chamber 104, the outlet passage 24*a*, and the reservoir 34. The land 112 blocks fluid communication between the working chamber passage 102*a* and the inlet passage 22*a*. When the working chamber 92*a* is contracting and the valve member 106 is in the first position, fluid in the working chamber 92*a* is discharged to the reservoir 34.

Figure 4:
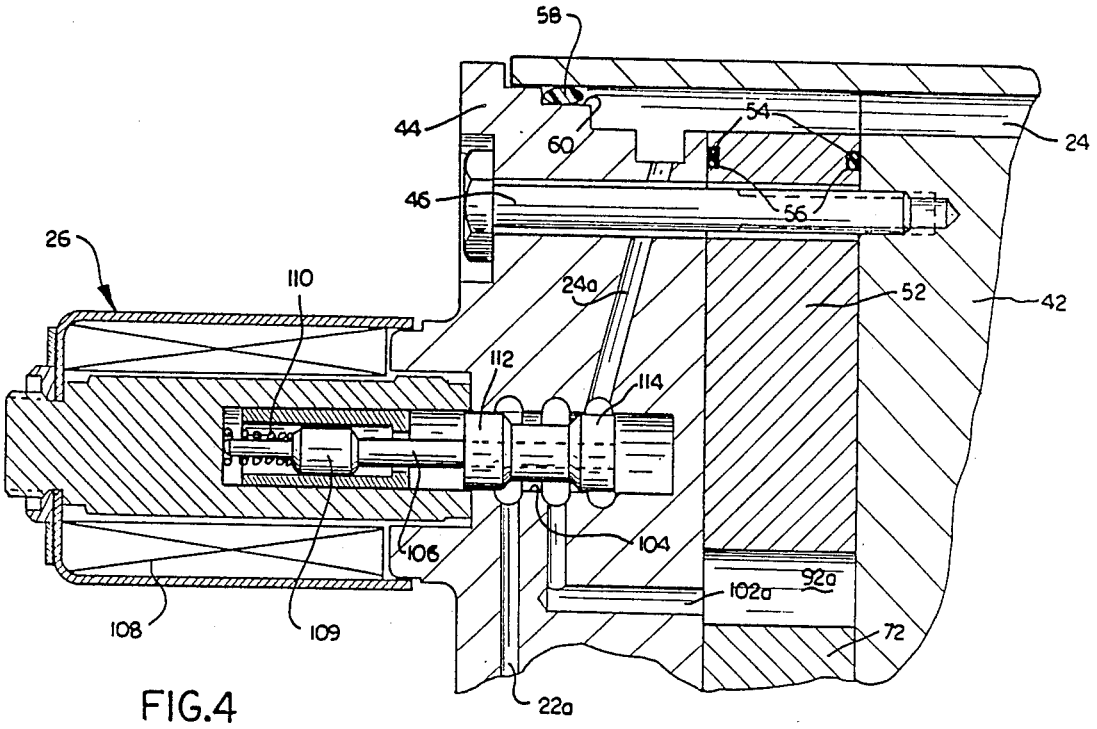
FIG. 4 is a view, similar to FIG. 3, illustrating certain parts in a different position.

FIG. 4 illustrates the second position of the valve member 106, which is also referred to as the actuated condition. When the control valve 26 is actuated by application of an electrical signal to the coil 108, the valve member 106 moves to the left, as viewed in the Figure. The second position provides fluid communication between the working chamber 92*a*, the working chamber passage 102*a*, the fluid chamber 104 the inlet passage 22*a*, and the pump 32. Concurrently, fluid communication between the outlet passage 24*a* and the working chamber passage 102*a* is blocked by the land 114. When the valve member 106 is in this second position, the working chamber 92*a* is pressurized from the pump 32 which causes the working chamber to expand.

Pressurization and venting of the working chambers 92 results in rotary and orbital movement of the rotor 72 relative to the stator 52. Typically, the working chambers 92 are sequentially pressurized and then vented to the reservoir 34. In the illustrated embodiment, a maximum of three working chambers 92 can be pressurized at once since three working chambers will be expanding and three working chambers will be contracting at any given time during rotary and orbital movement of the rotor 72. The group of three working chambers 92 being pressurized would sequentially step one chamber at a time in a rotational direction opposite to the rotational movement of the rotor 72.

In accordance with the present invention, each of the control valve assemblies 26 is selectively actuatable to control fluid flow to and from its associated working chamber 92. When fluid flow is selectively directed to or from specific working chambers 92, movement of the rotor 72 of the hydraulic motor 20 and, in turn, movement of the output shaft 62 can be precisely controlled with regard to rotary speed, direction, and the final stop position of the output shaft. Also, starting and stopping characteristics of the output shaft 62 can be controlled as well as permitting incremental movement thereof.

The controller 30, which is preferably a microcomputer, is used to control motor operation in response to input signals by controlling energization of the control valve assemblies 26. The controller outputs electrical control signals to actuate selected ones of the control valve assemblies 26. The controller 30 outputs the electrical control signals in response to various input and/or motor feedback signals. Input signals are supplied by an appropriate input source 115 and feedback signals are received from the motor position sensor 28.

Figure 5:
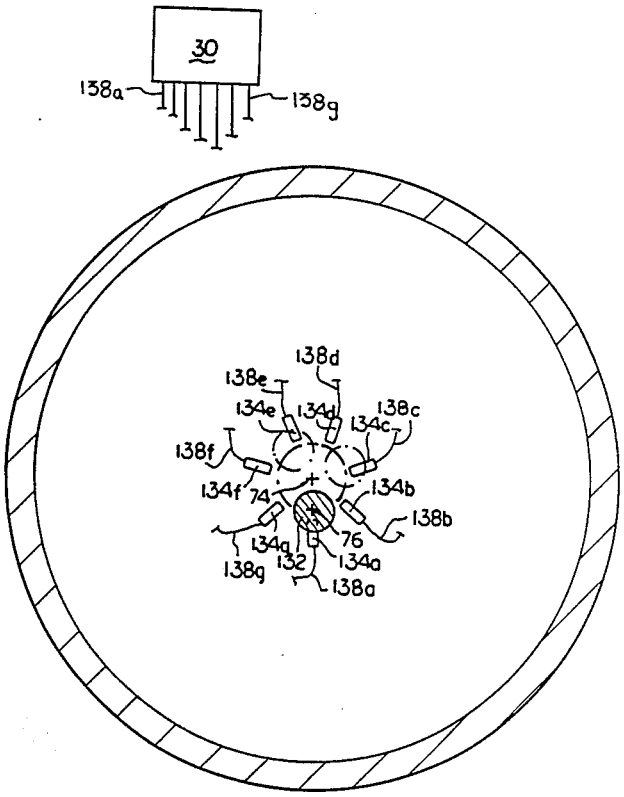
FIG. 5 is a plan view, taken approximately along the line 5—5 of FIG. 2 with certain parts removed for clarity.

Present motor conditions, such as position, direction of rotation, and speed of rotation of the output shaft 62, are derived from the feedback signal received from the position sensor 28. The position sensor 28 includes a magnet 132 fixed in the center of an end portion of the wobble shaft 66. The magnet 132 is preferably a permanent bar magnet and is secured in a central bore in the wobble shaft 66. The poles of the magnet 132 are in line with the longitudinal axis 76 of the wobble shaft 66. A pole end of the magnet 132 extends axially from the central bore of the wobble shaft 66. The position sensor 28 further includes a plurality of Hall effect sensors 134 (FIG. 5) fixed in an annular array to the end cap 44 about the axis 74. The number of Hall effect sensors 134 preferably corresponds to the number of working chambers 92 in the hydraulic motor 20 with each working chamber 92 having an associated Hall effect sensor 134 radially aligned therewith.

As the wobble shaft 66 rotates and orbits during operation of the motor 20, the magnet 132 approaches and moves past each Hall effect sensor 134 in sequence. Each Hall effect sensor 134 outputs an electrical signal having a characteristic, such as magnitude, indicative of the position of the magnet 132 with respect thereto. As the magnet 132 approaches and moves past a Hall effect sensor 134, such sensor outputs an electrical signal indicative of such changing relative position. Each Hall effect sensor 134 is connected by wires 138 to the controller 30. The controller 30 monitors the output signal from each of the Hall effect sensors 134 and determines the rotational and orbital position of the wobble shaft 66 therefrom. Speed of output shaft rotation is determined by the controller 30 based upon changing position of the wobble shaft 60 as a function of time. Direction of rotation is determined by the controller 30 by monitoring passes of the magnet 132 by adjacent sensors 134.

Once the position of the wobble shaft 66 has been determined, the orientation of each of the working chambers 92 is known. When a command is received from the input source 115 to position the output shaft 62 in a new desired position, the controller 30 determines which of the working chambers 92 should be pressurized and which working chambers should be vented to move the rotor 72 from its monitored present position to the new desired position. Based upon this information, the controller 30 determines which control valve assemblies 26, if any, are to be actuated responsive to the determination of which of the working chambers 92 need to be pressurized or vented.

The controller 30 also controls the speed and direction of the output shaft 62 of the motor 20 in response to an input command from the input source 115. The controller 30 continuously determines the speed and direction of the motor output shaft 62 and compares the actual speed and direction against the desired speed and direction to insure proper motor operation. As mentioned, to determine speed and direction of the output shaft 62, the controller 30 monitors the feedback position signal from at least two of the adjacent Hall effect sensors 132 of the position sensor 28. For example, when the position sensor 28 outputs signals to the controller 30 indicative of the magnet 132 passing over sensor 134*a* (FIG. 5) and then 134*b*, the controller determines that the wobble shaft 66 is rotating counterclockwise, as viewed in FIG. 5. Also, the controller 30, by monitoring an internal clock, measures the time lapse between receiving the feedback signals indicative of the magnet 132 moving past the adjacent Hall effect sensors 134*a* and 134*b*. From this time lapse, the controller 30 determines the rotational speed of the wobble shaft 66.

The controller 30 includes a microcomputer having a central processor, random access memory ("RAM"), and read only memory ("ROM"). The ROM has control program logic permanently stored therein. The RAM serves as temporary storage for (i) motor position data received from the position sensor 28, (ii) input data, and (iii) other program and control needs. The microcomputer compares the input signal from the input source 115, to the existing condition of the motor 20. If the existing condition of the motor 20, i.e., position, direction of rotation, or speed of rotation of the output shaft 62, does not correspond to the desired motor condition within a predetermined tolerance range, the control program generates control signals to the control valve assemblies 26 to change the condition of the motor 20 until the monitored motor condition conforms to the desired motor condition.

Figure 6:
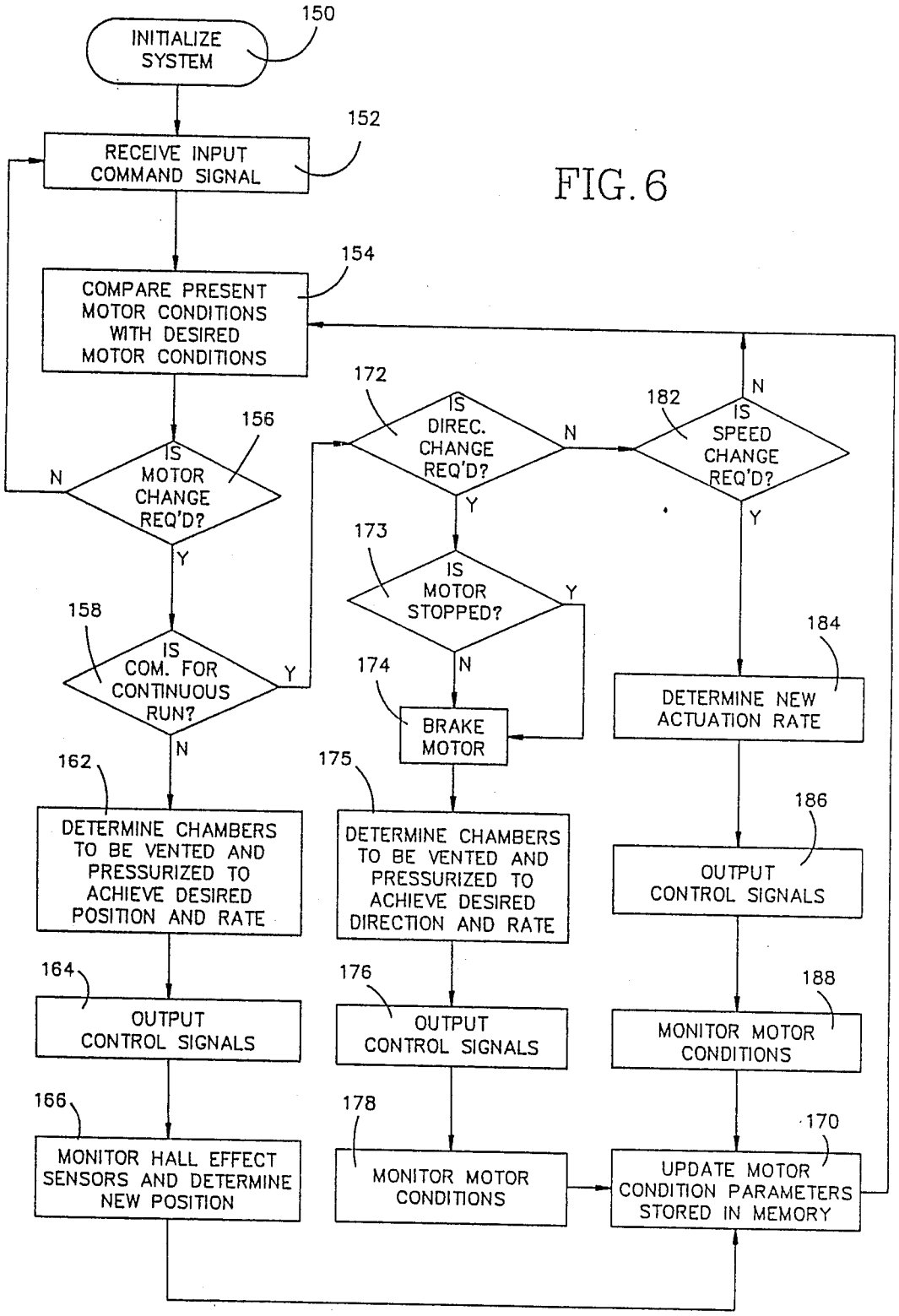
FIG. 6 is a flow diagram illustrating operating steps performed by a controller of the present invention and FIG. 7 is a schematic illustration of another embodiment of the present invention in fluid motor.

The flow chart of FIG. 6 illustrates one embodiment of program logic usable by the controller 30 to control the electrical commutation apparatus of the present invention. The program begins with step 150 which initializes the internal devices of controller 30 and activates the pump 32 to pressurize the inlet passage 22. During the initialization step 150, no electrical signals are outputted from the controller 30 to any of the control valve assemblies 26. The springs 110 bias each of the respective valve members 106 to the first position thereby venting all of the working chambers 92 to the reservoir 34. The RAM of the controller 30 is initially cleared. As part of step 150, the controller 30 determines the present position of the wobble shaft 66 from the output signals from the Hall effect sensors 134 and enters the position information into the RAM memory. The program then proceeds to step 152 where the controller 30 receives an input command signal from the source 115. The input source 115 can be any of several known devices. For example, a keyboard can be used to input a desired motor operation or a desired position of the motor output shaft 62. The input source 115 may be a computer. Also, the input source could be a "joystick" in combination with an interface to generate input signals commensurate with movement of the "joystick."

When an input signal is received by the controller 30, a comparison is done in step 154 to compare the present motor conditions (position, speed and direction), which are stored in the RAM memory, to the desired motor condition. In step 156, a determination is made as to whether a change in motor condition is required, i.e., speed, direction or position of the output shaft 62 are not as desired. If the determination in step 156 is negative, as would occur when the present motor condition is equivalent to the desired motor condition being inputted from the input source 115, the program returns to step 152 where the controller awaits a new command.

If the determination in step 156 is affirmative, the program proceeds to step 158 wherein a determination is made as to whether the motor 20 has been commanded, by the input signal, to run in a continuous run mode. If the determination in step 158 is negative, this means that the motor output shaft 62 is not to run in a continuous mode but is to be rotated from the present rotary position to a new rotary position. The program then proceeds to step 162 wherein the controller determines which working chambers 92 need to be pressurized and which working chambers need to be vented to cause the rotor 72, and thus the output shaft, to rotate to the desired position. One or more working chambers 92 may be required to be sequentially pressurized and vented before the desired rotational position is achieved. In step 164 the electrical control signals are outputted to the control valve assemblies 26 responsive to the determination made in step 162. In step 166, the Hall effect sensors 134 are monitored and the new position of the output shaft 62 is determined. The program then proceeds to step 170 wherein the controller RAM is updated with the new monitored position. The program then returns to step 154. The return to step 154 insures that the new motor position is equivalent to the desired position. If not, the loop just described is re-executed.

If the determination in step 158 is affirmative, i.e., it is desired to run the motor continuously, the program proceeds to step 172 where a determination is made as to whether there is a direction change required. If the motor output shaft 62 is already running in a continuous mode but is running a direction opposite that desired, the determination in step 172 will be affirmative. Also, if the motor output shaft 62 is stopped and is being commanded to move in a direction, the determination in step 172 is affirmative. Assuming an affirmative determination in step 172, the program then proceeds to step 173 where a determination is made as to whether the motor output shaft is stopped. If the determination is affirmative, the program proceeds to step 175. If the determination is negative, i.e., the output shaft 62 is moving but in a direction opposite from the desired direction, the program proceeds to step 174 where the motor 20 is braked. Braking of the motor 20 can be accomplished in several ways, such as venting working chambers 92 that are expanding. A "hard" brake action can be achieved by pressurizing working chambers 92 that are contracting, while venting working chambers that are expanding. In step 175, the controller determines which working chambers 92 need to be vented or pressurized to achieve the desired direction and rate of rotation of the output shaft. In step 176 new control signals are outputted to the control valve assemblies 26 from the controller 30 to drive the motor output shaft 62 in the desired direction. In step 178, the motor conditions, i.e., speed and direction, are measured and the controller's RAM memory for the motor conditions is updated in step 170. The program then returns to step 154.

If the motor output shaft 62 is already running in a continuous run mode and is running in the desired direction, the determination in step 172 will be negative. The program then proceeds to step 182 where a determination is made as to whether the speed of the motor output shaft 62 is as desired or needs to be changed. If the measured speed is equal to the desired speed, the program returns to step 154. If the speed is not as desired, the determination in step 182 is affirmative and the program proceeds to step 184 where the controller determines the control valve actuation rate needed to achieve the desired rotational speed of the motor output shaft 62. In step 186, the controller 30 outputs the control signals at a rate to make the actual motor speed equal to the desired motor speed. The program, in step 188, monitors the speed of the motor 20 and then proceeds to step 170 where the speed condition parameter is updated in the microcomputer's RAM memory.

To better appreciate operation of a motor system incorporation the present invention, a specific example is considered. Assume that the output shaft 62 of the motor 20 is initially stopped. When the system is enabled in step 150, the controller 30 monitors the output signals from the Hall effect sensors 134 and determines the rotational position of the output shaft 62 therefrom. The controller 30 then stores the information in its RAM memory. Assume that an input signal is received in step 152 from an appropriate source which corresponds to rotation of the output shaft 62 in a clockwise direction, as viewed from the right in FIG. 2, and at a specific rate. The controller 30, in step 154, compares the present motor conditions (the motor shaft stopped) to the desired motor condition (motor shaft turning clockwise at a desired rate). Since the desired motor condition is different than the present motor condition, the determination in step 156 is affirmative.

If no position information is included as part of the input signal received in step 154, the command is considered as a continuous run command, i.e., the output shaft 62 will be continuously driven in the direction and at the rate last commanded until a new input signal is received. The determinations in steps 158, 172 and 173 are all affirmative. The controller 30 determines, in step 175, which working chambers 92 need to be vented and pressurized to achieve the clockwise rotation. Also, the controller 30 determines the rate of pressurization needed to achieve the rotational velocity desired.

The controller 30 then outputs an electrical actuation signal through wire **122*g* so that the valve member 106*g* associated with working chamber 92*g* moves from the first position to the second position to pressurize that working chamber 92*g*. Pressurization of working chamber 92*g* causes the rotor 72 to start to rotate about axis 76 in a counterclockwise direction and to orbit about axis 74 in a counterclockwise direction, as viewed in FIG. 1. This causes the output shaft 62 to rotate in a clockwise direction, as viewed from the right in FIG. 2**.

During rotation of the wobble shaft 66, the magnet 132 (FIG. 5) rotates and orbits, and thereby changes the magnetic flux density at the Hall effect sensor **134*a*. Such change is measured by the controller 30 from the Hall effect sensor feed-back signal through wire 138*a*. Since further clockwise rotation of the output shaft 62 is desired, controller 30 (FIG. 1) generates an electrical signal to move the valve member 106 in the control valve assembly 26 associated with working chamber 92*a* to next pressurize working chamber 92*a*. Working chamber 92*b*** is subsequently pressurized.

For continued clockwise rotation of the motor output shaft 62, working chamber **92*c* is next pressurized and, concurrently, working chamber 92*g* is vented, since the working chamber 92*g* is in a position where it begins to contract in volume. This sequential pressurization and venting of the working chambers 92 is continued until the controller 30 receives a new input signal from the input source 115. The controller 30** continues to monitor the motor speed and direction to insure that the actual motor conditions equal the desired motor conditions.

If a large of torque is initially required from the motor 20, the controller 30 begins by actuating three adjacent control valve assemblies 26 for three adjacent expanding working chambers 92. The control valve assemblies 26 of the working chambers 92 are subsequently actuated in groups of three with the group stepping one valve position for each next actuation. For example, assume that the rotor 72 is commanded by the input signal to be rotated clockwise as viewed from FIG. 1 with a large amount or torque. Control valve assemblies **26*e*, 26*f*, 26*g* would be initially actuated to pressurize respective chambers 92*e*, 92*f*, 92*g*. For continued clockwise rotation, valves 26*f*, 26*g*, 26*a* would be next actuated to pressurize respective chambers 92*f*, 92*g*, 92*a***. As can be appreciated, the second group of three chambers pressurized stepped one working chamber in a counterclockwise direction from the first group actuated.

Once the motor 20 is at the desired speed, less fluid is needed to retain the motor at the same speed. Instead of sequentially pressurizing each fluid working chamber, it is possible to skip certain chamber pressurization and pressurize alternate working chambers.

To gradually stop the motor, the controller 30 vents all of the working chambers 92. The wobble shaft 66 continues to rotate due to inertia and gradually slows to a stop. If a sudden or "hard" stop is required, the controller 30 determines which of the decreasing volume working chambers 92 should be pressurized to thereby oppose further rotation of the rotor 72.

Figure 7:
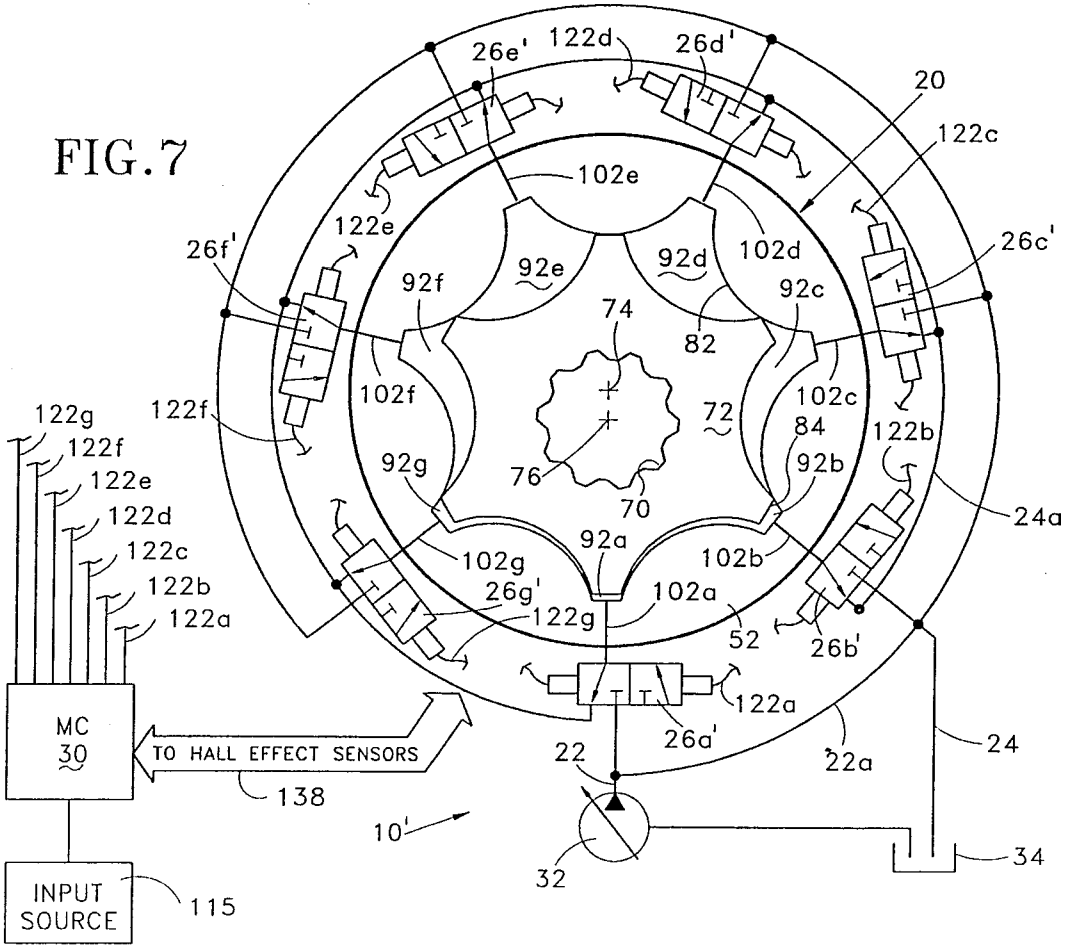

This invention has been described with reference to a preferred embodiment. For example, the passage 22 was described as the inlet connected to the pump 32 and the passage 24 was described as the outlet in communication with the reservoir 34. It will be appreciated that these passages could be functionally reversed to have the passage 22 in communication with the reservoir 34 and the passage 24 connected to the pump 32. In such an embodiment, the valves 26 would be adapted to work in a manner oppositely from that described above. Also, the valve assembly 26 can be reversed from that described with reference to FIG. 1 to that shown in FIG. **1*a*. The valve assembly 26 can be arranged so as to be spring biased to a second condition when the coil is not energized and moved to the first condition by energizing the coil. Also, the contorl valve assemblies 26 have been described as a single solenoid device which includes a spring 110 which biases the valve member 106 to a first position when the coil 108 is not energized. It will be apparent to those skilled in the art that these control valve assemblies 26 can be replaced with value assemblies 26' each having a pair of solenoids that oppositely act upon its associated spool member as is shown in FIG. 7**. When one solenoid is actuated, the valve spool moves to a first condition to provide fluid communication between the associated working chamber and the inlet passage. When the second solenoid is actuated, the valve spool moves to a second condition to provide fluid communication between its associated working chamber and the outlet passage. Other modifications and alterations may occur to those skilled in the art upon reading and understanding this specification. It is my intention to include all such modifications and alterations insofar as they come within the scope of the appended claims.

Having described a preferred embodiment, I claim:

1. An electrical commutation apparatus for a hydraulic device having a rotor and a stator, the rotor and stator having a plurality of teeth that cooperate during relative movement to define a plurality of variable volume working chambers, said apparatus including:

an inlet chamber connectable to a source of pressurized fluid;

an outlet chamber connectable to a reservoir;

a plurality of electrically responsive valve means, each working chamber having an associated valve means which is individually controllable, each valve means being in fluid communication with the inlet chamber and the outlet chamber and its associated working chamber and being responsive to an associated electrical control signal to selectively provide, in one condition, fluid communication between the inlet chamber and its associated working chamber and, in a second condition, fluid communication between the outlet chamber and its associated working chamber.

2. The apparatus of claim 1 wherein each valve means is a solenoid operated valve having a movable valve member spring biased to the first condition and movable to the second condition in response to the electrical control signal.

3. An apparatus comprising:

a gear set including a first member having a plurality of internal teeth, a second member located within said first member and having a plurality of external teeth, the number of external teeth of said second member being one less than the number of said internal teeth of said first member, the teeth of said first and second members cooperating to define a plurality of variable volume working chambers, said first and second members being mounted for relative orbital and rotatable movement, some of said working chambers expanding and others of said working chambers contractng during such relative movement;

an inlet passage connectable to a source of pressurized fluid;

an outlet passage connectable to a reservoir; and a plurality of electrically actuatable valve means, each said working chamber having an associated valve means for directly controlling fluid communication between such working chamber and the outlet passage and inlet passage, each valve means having a first condition and a second condition, said first condition permitting fluid communication between its associated working chamber and said outlet passage, said second condition permitting fluid communication between its associated working chamber and said inlet passage, each of said valve means including means responsive to a respective electrical control signal for selectively actuating such valve means to one of said conditions independent of the condition of any of the other valve means.

4. An apparatus as set forth in claim 3 further including control means for generating said electrical control signals.

5. An apparatus as set forth in claim 4 wherein each of said valve means comprises an electrically actuated solenoid valve electrically connectable to said control means and having a valve member biased to one of said conditions, energizing a solenoid valve moving its associated valve member to said other condition.

6. An apparatus as set forth in claim 5 further including position sensor means for sensing the relative position between said first member and said second member and for generating an electrical signal indicative thereof.

7. An apparatus as set forth in claim 6 wherein said control means includes means for comparing an input signal indicative of a desired position relationship between the first and second members to the sensed position signal and means for generating electrical control signals to each of said valve means in response to the comparing means to effect the desired position relationship.

8. An apparatus as set forth in claim 6 wherein said control means includes means for determining direction and speed of relative movement between said first and second members, means for comparing the determined direction and speed against a desired direction and speed inputted from an input source, and means for generating electrical control signals to each of said valve means in response to the comparing means to effect the desired direction and speed of relative movement between said first and second members.

9. An apparatus as set forth in claim 3 further including a fluid pump connected to a reservoir and to the inlet passage for providing said pressurized fluid, said outlet passage connected to said reservoir.

10. An apparatus comprising:

a fluid motor having a gerotor gear set including an internally toothed first member and an externally toothed second member, the teeth of said first and second members cooperating to define a plurality of variable volume working chambers, said first and second members being relatively rotatable and one of said members being orbital relative to the other in response to expansion and contraction of the working chambers;

an inlet passage for conducting pressurized fluid to the working chambers to effect expansion of the working chambers;

an outlet passage for conducting fluid from the working chambers upon contraction of the working chambers;

a plurality of valve means each of which is separately actuatable between a first condition and a second condition, each working chamber having an associated valve means for directly controlling fluid communication between such working chamber and said inlet passage and said outlet passage, said first condition blocking fluid flow from said inlet passage to its associated working chamber and permitting fluid flow to said outlet passage from its associated working chamber, said second condition blocking fluid flow from its associated working chamber to said outlet passage while permitting fluid flow from said inlet passage to its associated working chamber, each of said valve means including electrical actuation means responsive to a respective electrical control signal for selectively and individually actuating such valve means to at least one of said first and second conditions; and control means for generating the respective electrical control signal to actuate a selected one of said plurality of valve means to a desired one of said conditions.

11. An apparatus as set forth in claim 10 wherein said plurality of valve means comprises a plurality of electrically actuated solenoid valves electrically connectable to said control means.

12. An apparatus as set forth in claim 10 wherein each of said plurality of valve means includes an electrically actuated solenoid valve having a pair of solenoids that oppositely act upon an associated spool member of the valve, a first one of said solenoids, when actuated, moving its associated valve spool to a first condition to provide fluid communication between its associated working chamber and the inlet passage, a second one of said solenoids, when actuated, moving its associated valve spool to a second condition to provide fluid communication between its associated working chamber and the outlet passage.

13. An apparatus as set forth in claim 10 further including position sensor means for sensing the position between said first member and said second member and for generating an electrical signal indicative thereof.

14. An apparatus as set forth in claim 13 wherein said control means for generating the control signal includes means for comparing an input signal indicative of a desired position relationship between said first member and said second member to the sensed position, the generated control signal controlling the condition of said plurality of valve means to effect the desired position relationship.

15. An apparatus as set forth in claim 14 further including a pump in fluid communication with said inlet passage for supplying pressurized fluid thereto.

16. An apparatus as set forth in claim 10 wherein said control means for generating the control signal includes means for determining direction and speed of relative movement between said first and second members, means for comparing the determined direction and speed against a desired direction and speed inputted from an input source, and means for generating said electrical control signals in response to the comparing means to effect the desired direction and speed of relative movement between said first and second members.

17. An apparatus as set forth in claim 10 wherein each of said plurality of valve means includes a movable valve member disposed in a chamber which is in fluid communication with said inlet passage, said outlet passage and one of said plurality of working chambers, said valve member being drivingly connected with said electrical actuation means, said valve member being selectively movable to provide fluid communication between said one working chamber and one of said passages.

* * * * *